United States Patent [19]

Volpe et al.

[11] 4,022,254

[45] May 10, 1977

[54] WEFT YARN CONTROL DEVICE

[75] Inventors: Richard L. Volpe, Hopedale; Claude Wheeler, South Grafton, both of Mass.

[73] Assignee: Rockwell International Corporation, Pittsburgh, Pa.

[22] Filed: Oct. 18, 1976

[21] Appl. No.: 733,569

Related U.S. Application Data

[63] Continuation of Ser. No. 607,566, Aug. 25, 1975.

[52] U.S. Cl. ..... 139/453
[51] Int. Cl.[2] ..... D03D 47/38
[58] Field of Search ..... 139/450, 453

[56] References Cited

UNITED STATES PATENTS

| | | | |
|---|---|---|---|
| 1,964,692 | 6/1934 | Benjamin | 139/453 |
| 3,455,340 | 7/1969 | Golobart | 139/453 |
| 3,621,885 | 11/1971 | Egloff et al. | 139/450 |
| 3,780,775 | 12/1973 | Sprague | 139/453 |

*Primary Examiner*—Henry S. Jaudon

[57] ABSTRACT

A weft separator device for shuttleless looms or the pick and pick type in which any one of a plurality of weft yarns from separate sources can, by positioners individual to each weft yarn, be located for insertion into a warp shed. The device includes a pivotally mounted finger member operatively associated with each of the positioners and is effective in providing positive separation between a selected weft yarn and those in their inactive positions in the area intermediate the edge of the woven fabric from which the weft yarns extend to their respective positioners.

4 Claims, 3 Drawing Figures

WEFT YARN CONTROL DEVICE

This is a continuation of application Ser. No. 607,566, filed Aug. 25, 1975.

BACKGROUND OF THE INVENTION

In looms which utilize weft yarn that is furnished from an outside source and is not carried to and fro through the shed by the shuttle or carrier itself, it is common practice to insert each pick of weft by two reciprocating elements. In this form of shuttleless loom, the element which introduces the weft into the wrap shed is known as the inserting carrier and that which receives or has transferred to it the introduced weft to be drawn through the remainder of the shed is known as the weft receiving or extending carrier.

In the weaving of particular types of fabric, it is desirable to mix the weft yarns by drawing them from separate sources of supply so as to distribute variations therein and give the fabric a uniform overall appearance. By mixing weft yarns from different sources of supply patterning effects can be had by utilizing different types of weft yarn as well as weft yarns of a different color to form stripes, for example, and is accomplished by selecting one color or type of yarn for a predetermined number of picks and subsequently selecting a second and then a third and so on.

When weaving with a plurality of weft yarns in pick and pick type shuttleless looms to which the present invention is applicable, the various yarns extend from their source through known forms of guides and tensioning devices to and through the particular weft positioning element individual thereto. These positioning elements are effective in selectively moving their weft yarns between their inactive or storage position and that position whereat they will be taken by the inserting carrier and introduced into the warp shed. The positioning elements are usually provided with eyelets on their free ends through which a weft yarn extends and are engaged in relatively close proximity, one with the other, so that they have a substantially common active or selected position for presenting a weft yarn to the inserting carrier.

The required close positioning of the plurality of weft yarns in the area where they extend from their respective positioners to the edge of the fabric, has presented a very serious problem of certain types of weft yarns knitting or clinging together. Such a problem will oftentimes result in failure of the carrier to pick up and introduce a selected weft yarn or else it may even pick up and introduce more than one weft yarn. The latter condition is made possible when one yarn is being moved towards its selected position and becomes entangled with the previously selected yarn that is being simultaneously moved to its inactive position. The condition of failure to introduce a weft yarn can occur when a particular yarn to be selected has knit with or become entangled with an adjacent inactive yarn. In this event the selected yarn's positioner will move to the selected position but the entangled portion of the yarn will cling to the non-selected one and will not be lowered to its carrier pick-up position. Additionally the failure to introduce a weft yarn can also be caused by a selected weft yarn knitting with or clinging to an immediately adjacent inactive weft yarn in the area intermediate the thread cutter and the fabric edge. Such a condition will cause the non-selected weft to enter the weft cutter with the selected weft as the latter is guided into said cutter after being received into the guide slot formed in the back wall of the inserting carrier as the latter is caused to move toward the shed. The cutter will sever both the selected and non-selected wefts which will permit the selected weft to be introduced into the shed in a normal manner; however, when the severed inactive weft is again selected it will fail to be taken by the inserting carrier causing a cessation of loom operation. The types of weft yarn which are the most troublesome are those of low count having a fuzzy texture such as natural fibers or blends thereof as well as novelty yarns that vary in size and texture. The weft yarns are maintained under a predetermined amount of tension and any loss of tension which would create slack in the weft contributes highly to the possibility of adjacent weft yarns becoming entangled. A loss of tension in high twist yarn is especially troublesome for a slight amount of slack in such yarns will cause then to twist upon themselves to the extent of entanglement with adjacent yarns.

The weft yarn control device comprising the invention has eliminated the problems described above by providing a weft separator which is operatively associated with the weft positioners and is effective in assuring a positive separation between the weft yarns in their inactive positions and the selected yarn in its active position.

SUMMARY OF THE INVENTION

The weft yarn control device for shuttleless looms of the pick and pick type comprising the invention includes an elongated finger mounted in operative association with the plurality of weft yarns extending from the edge of the fabric to their respective positioners and is pivotably driven between positions for effecting a positive separation between a selected weft yarn and those in their storage or inactive positions. This elongated finger is carried on a vertically disposed rod member that is oscillated by gear means that are actuated by a cam-controlled push rod. This push rod includes a follower assembled on one end and is biased in a direction to cause said follower to maintain contact with the outer periphery of a cam that is mounted for rotating movement within the loom's weft control housing disposed on the upper forward portion of the loom.

It is a general object of the invention to provide a weft yarn control or separator device which will provide a more efficient control of the weft in shuttleless looms of the pick and pick type which are adapted to selectively utilize weft yarn drawn from more than a single source.

It is a further object of the invention to provide a weft yarn control device for shuttleless looms which is effective in providing a positive separation between the active and inactive weft yarns adjacent the edge of the fabric during the picking cycle.

A further and more specific object of the invention is to provide a weft yarn control device for shuttleless looms of simplified construction, which is relatively inexpensive to manufacture and with long life expectancy.

These and other objects of the invention will become more fully apparent by reference to the appended claims and as the following detailed description proceeds in reference to the figures of drawing wherein:

DESCRIPTION OF THE PREFERRED EMBODIMENT

As the general construction and operation of a loom, to which the present invention is applicable, are well-known and familiar to those conversant in the art, and as the invention is entirely concerned with a weft yarn separator device for such looms, it is only considered necessary here to illustrate and describe those parts which are directly concerned with a preferred form of the present invention.

Figure 1:
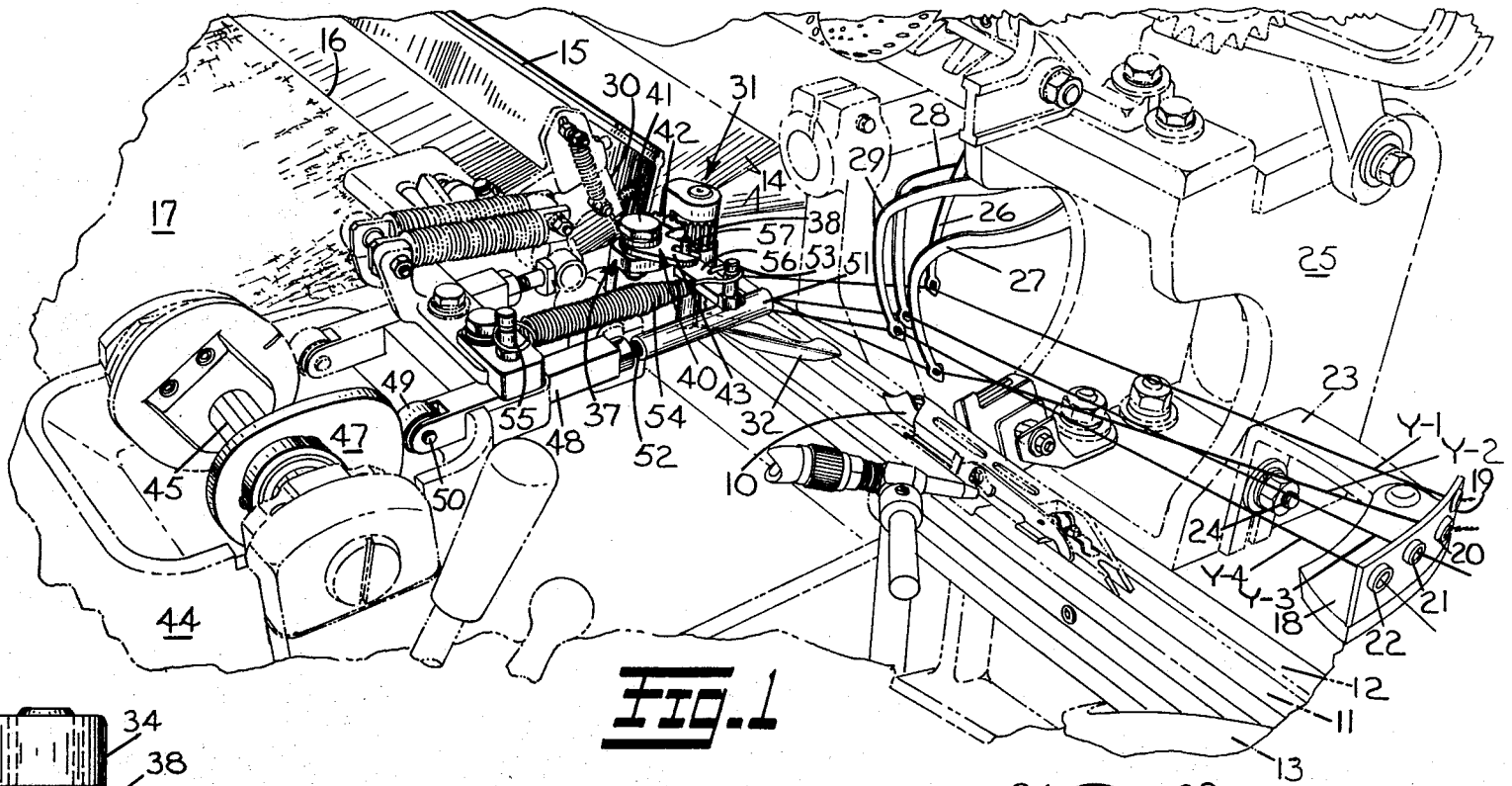
FIG. 1 is a perspective view of a portion of the right-hand side of a shuttleless loom showing the device according to the invention applied thereto.

In FIG. 1 a weft inserting carrier is shown at 10 and is fixed to the end of a flexible tape 11 which moves through a tape guide 12 and which is wrapped about and unwrapped from a tape wheel within a housing 13 disposed at the side of the loom. While the invention will be described in connection with a flexible tape type shuttleless loom, it is to understood that it can also be used effectively with other types of shuttleless looms.

Warp yarns 14 extend through a conventional harness arrangement (not shown) that is effective to form shed openings into which the inserting carrier 10 enters to carry with it any one of a plurality of weft yarns identified in FIG. 1 by Y-1, Y-2, Y-3 and Y-4.

Figure 3:
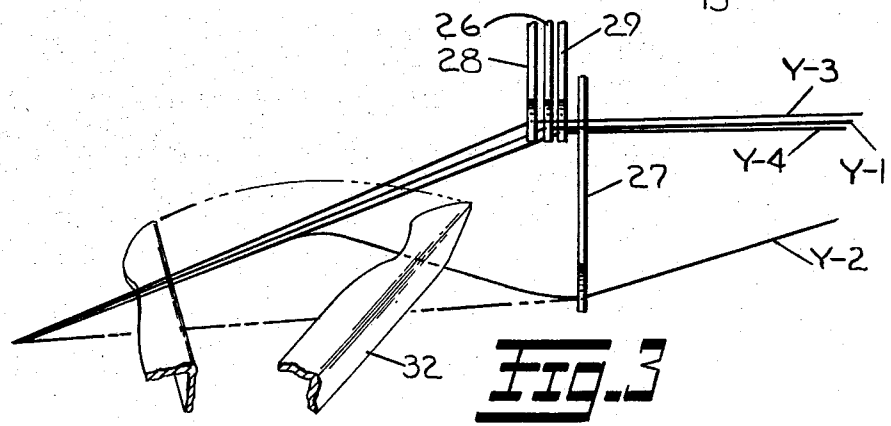
FIG. 3 is a view in side elevation and partially in perspective showing the clinging of one weft yarn to another and the manner in which such yarns are separated.

The usual form of reed 15 carried on a reciprocating lay beam (not shown) serves to beat each inserted length of weft into the fell 16 of the fabric 17. Each of the weft yarns Y-1, Y-2, Y-3 and Y-4 is drawn from a separate source (not shown) and as illustrated in FIG. 1 extend through a guide member 18 which is provided with individual eyelets, disposed in spaced relation, for each weft yarn and are identified by numerals 19, 20, 21 and 22 respectively. Guide member 18 is adjustably carried on an L-shaped support 23 which by means of a bolt 24 is assembled on the outer side of a support frame 25. This support frame 25 carries a well-known form of a weft selector unit of which only a portion of its plurality of weft positioners are shown. These weft positioners define arcuated fingers having eyelets formed adjacent their free ends through which a weft yarn is caused to extend and are identified by numerals 26, 27, 28 and 29. As shown in FIGS. 1 and 3 weft yarn Y-1 extends through the eyelet formed in weft positioner 26, yarn Y-2 through 27, yarn Y-3 through 28 and yarn Y-4 through the eyelet formed in positioner 29. From the eyelets in the weft positioners the individual weft yarns extend to the edge of the fabric where they are held in a known manner.

In FIGS. 1 and 3 weft positioner 27 with its yarn Y-2 is shown in its selected or active position whereat said yarn Y-2 will be taken by the carrier 10 and introduced into the warp shed. In these figures of drawing the remaining weft positioners 26, 28 and 29 with their weft yarns Y-1, Y-3 and Y-4 are shown in their inactive or so-called weft storage positions. After the carrier 10 picks up the selected weft yarn, during its movement toward the shed and after the weft enters the gripping element in the forward wall of the carrier, said weft is cut adjacent the fabric edge by a known form of a weft cutter shown at 30 in FIG. 1.

Figure 2:
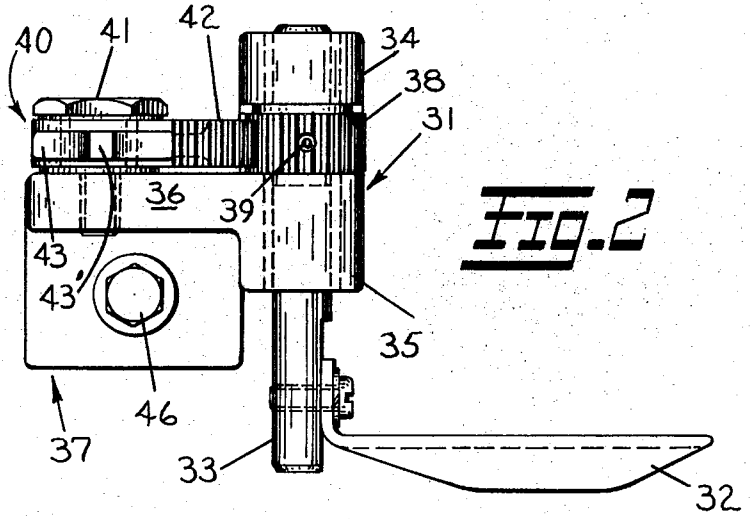
FIG. 2 is a view in side elevation of the weft yarn separator device according to the invention showing its means of support and a portion of the actuating elements therefor.

The weft yarn control device according to the invention is identified generally in FIGS. 1 and 2 by numeral 31 and includes an elongated finger member 32 mounted for continuous pivotal movement, in timed sequence with the weaving cycle, to and from a position located intermediate a selected weft yarn and those in their storage or inactive positions.

Finger member 32 is assembled to and adjacent the lower end of a vertically disposed rod 33 by means of a screw 34 and is disposed so as to extend in a direction normal to the axis of said rod. Extending in an upwardly direction the upper portion of rod 33 is journaled in a pair of spaced and aligned journal blocks 34 and 35 that are formed integral with a horizontally disposed shelf 36 of a support bracket generally indicated by numeral 37.

In the space intermediate the journal blocks 34 and 35 a pinion 38 is assembled on rod 33 by means of a set screw 39. A doublearmed lever indicated generally by numeral 40 is pivotally mounted on shelf 36 of support bracket 37 by means of a cap screw 41 and has a first arm defining a gear segment 42 disposed in meshing relation with pinion 38. The second arm of this double-armed lever is depicted by numeral 43 and is bifurcated as at 43' (FIG. 2) which provides the means for pivoting said lever yet to be described.

The loom weft control housing is indicated by numeral 44 and includes the usual rotatably driven shaft 45 mounted therein. The drive means (not shown) for rotating shaft 45 is well-known to those conversant in the art and it is considered unnecessary to illustrate and describe this drive means.

The control housing 44 has a rearwardly extending arm (not shown) assembled to one side thereof and provides a mounting surface to which the support bracket 37 is attached by means of a bolt 46 (FIG. 2).

A cam member 47 (FIG. 1) is assembled on shaft 45 for rotation with the latter and is operatively connected to a tappet-like bar element 48. This tappet-like bar element is mounted for sliding movement in the rearward side of the weft control housing 44 and has a follower in the form of a roller 49 assembled in the forward bifurcated end of said bar element by means of a pin 50.

The opposite end of this bar element includes an extension rod 51 adjustably attached thereto as at 52 which has an upwardly directed pin 53 fixed to and adjacent the free end of said extension rod. One end of a coil spring 54 is connected to pin 53 with the opposite end thereof being connected to a pin 55 mounted on the upper and rearward portion of the weft control housing 44. Coil spring 54 serves to continuously urge bar element 48 in a forwardly direction and to maintain roller 49 in contact with the outer periphery of cam member 47.

The reciprocating movement of bar element 48 is transmitted to the double-armed lever 40 by means of a finger 56 one end of which is fixed to the extension rod 51, by any suitable means such as welding. Adjacent the opposite end of finger 56 an upwardly directed pin 57 is provided and is disposed so as to extend through the bifurcation 43' of the second arm 43 of the double-armed lever 40.

To summarize the operation, the inserting carrier 10 enters a warp shed and is caused to meet a companion or so-called extending carrier at a point adjacent the center thereof where the cut end of a selected weft yarn introduced by said inserting carrier is transferred, in a known manner, to said extending carrier and is drawn through the remainder of the shed to complete a single pick. When according to a predetermined pattern weft from another source is to be introduced, the weft positioner in the active position will be pivoted upwardly and move its weft yarn to an inactive or storage position. During this movement the weft positioner with the next weft yarn to be introduced into the shed is simultaneously moved to its active or selected position. Should the weft yarn being moved to the active position cling to an adjacent weft yarn or knit with the one being moved to its inactive position in the area intermediate the fabric edge and the weft positioners such as illustrated in FIG. 3 of the drawing, the elongated finger member 32 will pivot to a position between the selected weft yarn and the non-selected ones and separate in a positive manner any weft yarns which may become entangled with the selected weft yarn.

The cam-controlled reciprocating movement of bar element 48 and extension rod 51 causes finger 56 with its pin 57 to move in a like manner. This reciprocating movement of pin 57 pivots the double-armed lever 40 first in one direction and then the other by means of its association with said lever in the bifurcation 43' of the second arm 43. The pivotal movement of the double-armed lever 40 is transmitted by its gear segment 42, the pinion 38 causing the latter and rod 33 to oscillate and in timed relation to the weaving cycle to pivot finger member 32 to and from a position located intermediate a selected weft yarn and those in their storage or inactive positions.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. In a mechanism for selectively positioning in a shuttleless loom any one of a plurality of weft yarns drawn from separate sources of supply in a position for insertion as single picks into separate warp sheds by a suitable carrier, the improvement comprising:

a. a weft positioner for each source of weft mounted on the loom intermediate the latter and the edge of the fabric being formed and arranged for individual selective movement between an inactive position in which the weft yarn is out of position to be taken by the carrier and an active position in which the selected weft yarn is positioned to be taken by the carrier;

b. means carried by the loom in operative association with said weft positioners and the edge of the fabric to which the weft yarns are connected for effecting positive separation of the selected weft yarn from those in their inactive positions; and c. means for moving said separation means between operative and inoperative positions in timed sequence with the weaving cycle.

2. The mechanism according to claim 1 wherein said separation means includes an elongated finger member mounted for pivotal movement to and from a position located intermediate a selected weft yarn and the non-selected ones.

3. The mechanism according to claim 2 wherein said moving means includes:

a. a rod member for supporting said finger member;

b. gear means operatively associated with said rod member; and c. cam-controlled driving means connected to said gear means for effecting oscillating movement of said rod member.

4. The mechanism according to claim 3 wherein said cam-controlled driving means includes:

a. a rotatable cam member;

b. a bar element mounted on the loom for reciprocating movement;

c. means defining a cam follower attached to one end of said bar element; and d. biasing means for maintaining said cam follower in contact with said cam member.

* * * * *

UNITED STATES PATENT AND TRADEMARK OFFICE

CERTIFICATE OF CORRECTION

PATENT NO. : 4,022,254

DATED : May 10, 1977

INVENTOR(S) : Richard L. Volpe and Claude Wheeler

It is certified that error appears in the above-identified patent and that said Letters Patent are hereby corrected as shown below:

In the Abstract, line 1, delete "or" and substitute --of--.

In the Specification, column 5, line 31, after "42," insert --to--.

Signed and Sealed this

Sixteenth Day of May 1978

[SEAL]

Attest:

RUTH C. MASON
Attesting Officer

LUTRELLE F. PARKER
Acting Commissioner of Patents and Trademarks